US008672015B2

(12) United States Patent
Croteau

(10) Patent No.: US 8,672,015 B2
(45) Date of Patent: Mar. 18, 2014

(54) WINDOW PRIVACY AND PROTECTIVE COVERING

(76) Inventor: Michael Croteau, Everett, MA (US)

( * ) Notice: Subject to any disclaimer, the term of this patent is extended or adjusted under 35 U.S.C. 154(b) by 0 days.

(21) Appl. No.: 13/208,707

(22) Filed: Aug. 12, 2011

(65) Prior Publication Data

US 2012/0080153 A1 Apr. 5, 2012

Related U.S. Application Data

(60) Provisional application No. 61/389,470, filed on Oct. 4, 2010.

(51) Int. Cl.
*E06B 9/00* (2006.01)

(52) U.S. Cl.
USPC ..... 160/352; 160/88

(58) Field of Classification Search
USPC ..... 160/181, 378, 352, 90, 371, 369, 88, 160/183, 102, 103, 104, 105, 106; 52/202, 52/222, 63
See application file for complete search history.

(56) References Cited

U.S. PATENT DOCUMENTS 411,008 A * 9/1889 Braun ..... 160/220
564,413 A * 7/1896 Stilwell ..... 160/180
588,146 A * 8/1897 Havecotte ..... 126/544
717,319 A * 12/1902 Bain ..... 454/226
739,592 A * 9/1903 Elmendorf ..... 160/183
841,020 A * 1/1907 Kiper ..... 160/351
962,176 A * 6/1910 Templeton ..... 160/22
1,178,554 A * 4/1916 Thomson ..... 160/88
1,514,771 A * 11/1924 Kilcher ..... 160/88
1,545,224 A * 7/1925 Whealdon ..... 160/352
1,743,369 A * 1/1930 Mears ..... 160/102
1,767,487 A * 6/1930 Shogren ..... 49/388
2,093,314 A * 9/1937 MacDonald ..... 160/183
2,098,174 A * 11/1937 Giberson ..... 160/88
2,109,545 A * 3/1938 McGrane ..... 454/226
2,222,753 A * 11/1940 Sigfrid ..... 160/88
2,240,406 A * 4/1941 Kurtz ..... 160/88
2,266,854 A * 12/1941 Davis ..... 160/131
D136,527 S * 10/1943 Mulllner ..... D12/181
2,536,755 A 1/1951 Lombardo
2,572,363 A * 10/1951 Mayer et al. ..... 160/183
2,628,678 A * 2/1953 Webster ..... 160/90
2,736,933 A 3/1956 Olsen
2,931,578 A * 4/1960 Thompson ..... 126/629
3,121,922 A * 2/1964 Niese ..... 49/63
3,122,797 A * 3/1964 Valfredo ..... 49/450
3,227,206 A * 1/1966 Rocco et al. ..... 160/88
3,283,804 A * 11/1966 Yancey ..... 160/106
4,010,730 A * 3/1977 Mitchell ..... 126/547

(Continued)

*Primary Examiner* — Katherine Mitchell
*Assistant Examiner* — Johnnie A Shablack
(74) *Attorney, Agent, or Firm* — Daniel Boudwin; Global Intellectual Property Agency LLC

(57) ABSTRACT

The present invention relates to a device for security and privacy that is securable to the frame of a window and mountable from the interior of a building. The device comprises a slanted front panel mounted at an angle to allow an open bottom panel and side panels to provide airflow. The panels may be comprised of a mesh screen material to allow airflow when secured in place over an open window, providing airflow and privacy while still providing a level of security for a user. A vertical frame mounts to the rails of a sliding screen along its upper edge, and secures around the bottom of the sliding screen to allow synchronized movement of the two during operation.

3 Claims, 1 Drawing Sheet

(56) References Cited

U.S. PATENT DOCUMENTS

| | | | | | |
|---|---|---|---|---|---|
| 4,060,119 | A | * | 11/1977 | Nohmura et al. | 160/266 |
| 4,127,156 | A | * | 11/1978 | Brandt | 160/179 |
| 4,132,033 | A | * | 1/1979 | Esposito | 49/71 |
| 4,180,117 | A | | 12/1979 | Greer | |
| 4,360,053 | A | * | 11/1982 | Buckner | 160/352 |
| 4,969,291 | A | * | 11/1990 | Camara | 49/71 |
| 5,141,046 | A | * | 8/1992 | Duncan | 160/379 |
| 5,918,430 | A | * | 7/1999 | Rowland | 52/202 |
| 6,021,834 | A | | 2/2000 | Malott | |
| 6,161,605 | A | * | 12/2000 | Pena | 160/90 |
| 6,358,598 | B1 | | 3/2002 | Hicks | |
| 6,393,777 | B1 | | 5/2002 | Renfrow | |
| 7,654,045 | B2 | * | 2/2010 | Wiegel | 52/202 |
| 8,037,920 | B2 | * | 10/2011 | Svirsky et al. | 160/62 |
| 2007/0199259 | A1 | | 8/2007 | Parsley | |
| 2009/0236058 | A1 | * | 9/2009 | Wiegel | 160/372 |

* cited by examiner

WINDOW PRIVACY AND PROTECTIVE COVERING

CROSS REFERENCE TO RELATED APPLICATION

This application claims the benefit of U.S. Provisional Application No. 61/389,470 filed on Oct. 4, 2010, entitled "Scream Saver Awning."

BACKGROUND OF THE INVENTION

1. Field of the Invention

The present invention relates to a concealing external window covering. More specifically, the present invention relates to a privacy shield for windows that allows the inflow of air and light.

Many consumers wish to conceal and protect the contents of their homes, offices, and other venues in order to protect their lives from public view. Traditional methods for obscuring outside views into windows may be undesirable depending on the situation. For example, blinds, curtains, and shades effectively prevent passersby from being seeing into a home or office, but also completely block out sunlight and fresh air from entering, even if used while the windows are open. Excessive wind or outdoor weather can also damage such window items if used in conjunction with open windows, and such a configuration poses a security risk to the premises, as the windows are easily entered into when in an open configuration. A need exists in the art for a window covering that allows privacy, while not compromising airflow or security.

Traditional awning devices are useful for providing shade or privacy, and are generally affixable from the exterior of a window frame. While these devices are suited for their particular requirements, a further need arises for a privacy screen awning that is mountable from the interior of a window, allowing users that may live in high rise buildings or on upper levels of a building to easily mount such a device without handing the device from the exterior or resorting to expensive or dangerous methods to mount the device.

2. Description of the Prior Art

The present invention provides a new and unique device for adding privacy to windows. The device is a secondary, semi transparent or opaque window covering that is mountable to an existing sliding window frame from the inside of a building structure. The covering attaches along its upper edge to the sliding rail of a window frame using two pins, and to the bottom of a sliding window screen using an angled clip that accepts the bottom surface of the sliding window screen. A gap is created between the covering and the window by the angled positioning of a front panel, which provides privacy and coverage for the free field area of the window. At the base of the front panel is an opening that allows fresh air to enter. The construction and materials utilized in window cover device obstructs a direct viewing through the window to varying degrees while allowing inflow of light and fresh air. Its attachment to a sliding window frame also allows mounting from the interior of a room, while its connection to the window screen allows the device to be moved in conjunction with the window. This allows a user to position the device anywhere along the sliding rail without disconnecting it from the window frame.

Several patents have been issued and applications published disclosing similar devices; however these prior art devices have several known drawbacks. Several of the devices relate solely to awnings for windows, while others relate to complete coverings that obscure incoming light, such as storm windows or security windows. There exists a need for a device that provides privacy and security while still allowing airflow and sunlight to pass through, and one that is mountable to an existing slideable window frame from the interior of a room or building. The present invention fulfills this need.

Several patents and publications refer to secondary window coverings, similar to storm windows. Parsley, U.S. Patent Publication No. 2007/0199259 discloses a secondary window covering that can be placed on the interior or exterior of an existing window. The covering is configurable to windows or nearly any shape, including rectangular, arched or round. The covering provides additional thermal protection, security and tinting. A magnetic seal secures one or more secondary window coverings to the existing window. An alarm system can be incorporated into the secondary window to provide additional security. The construction of the secondary window allows the secondary window to be easily removed and reinstalled when required for either seasonal or year round protection.

Similarly, Rowland U.S. Pat. No. 5,918,430 discloses a removable storm shield, and method of attaching a removable storm shield, to protect an opening in the wall of a building structure from damage caused by foul weather conditions or other destructive acts. The device includes a convex panel having a centrally located portion with a substantially singularly convex cross-section that resists exterior forces and a flat peripheral portion for stabilizing surface contact with the exterior wall. Additionally, a plurality of fasteners attaches the panel to the wall through a plurality of slots in the flat portion through which each fastener secures the panel to the wall. Additionally, Hicks U.S. Pat. No. 6,358,598 discloses a flexible plastic window covering which combines the qualities of being translucent, colorful, easily installed in any size, self-adhering, removable and reusable, easily cleaned, wear and fade resistant, ultraviolet light absorbing, and decorative while providing privacy or hiding an unwanted view.

Further, Renfrow U.S. Pat. No. 6,393,777 discloses a window guard assembly having a multiple set of permanent window brackets installed on the exterior sides of a window frame of a building or residential home at the top and bottom thereof. A top set of window brackets is arranged with mounting brackets. A bottom set of window brackets is disposed on the bottom window framing as first and second mounting brackets, and the bottom brackets align with the top set of window brackets. The brackets facilitate the installation of a protective planar covering to prevent damage from flying debris during violent weather. The brackets can also facilitate substitution of a pair of decorative shutters during non-hazardous weather conditions.

The Parsley publication, and the Rowland, Hicks and Renfrow patents disclose devices similar to storm windows. While each of these devices may have a benefit and a device that satisfies a given requirement, such as increased temperature efficiency or protection from adverse weather elements, these devices are not designed to provide privacy, security and facilitate airflow through an open window. In fact, these devices are designed specifically to restrict airflow. The present invention provides a means to address privacy while allowing airflow, fulfilling a need that is not addressed in these prior devices.

Other patents have been issued related to awning devices. Lombardo, U.S. Pat. No. 2,536,755 discloses an adjustable all weather awning that permanently attaches to a window frame. The awning comprises blades that can be opened to admit light and air, and then closed to protect the window from rain, storms, and sunlight. Additionally, the awning has side doors which open and close independently of the blades to allow airflow.

Similarly to Lombardo, Olsen, U.S. Pat. No. 2,736,933 discloses an awning particularly of the type having a permanently mounted frame, and in particular an awning having glass panels, or panels of other transparent material mounted in a frame extended from a window frame. The transparent panels are removeable and replaceable with panels of tinted or slightly colored material to eliminate sun glare. Greer, U.S. Pat. No 4,180,117 discloses a window awning with a roll-up mechanism. The device includes a means for attaching one end of the awning fabric above the window, support arm assemblies extending from either side and each assembly coupled to opposite ends of the rollup mechanism, allowing the awning to be retracted.

Finally, Malott, U.S. Pat. No. 6,021,834 discloses a retractable awning assembly including a roller, a flexible canopy having an inner edge secured to a wall and an outer edge secured to the roller, and a pair of arm assemblies operable to move the roller between a retracted position adjacent the wall and an extended position spaced from the wall. A support arm includes a tube and a bracket rigidly secured at an intermediate position along the tube. A rafter arm includes telescoping inner and outer tubes and an inward facing button lock to secure the tubes in an extended position. The support arm has an upper end operably connected to the roller and a lower end pivotally secured to the wall. A travel latch for locking the support arm to the wall when the roller is retracted includes a latch member pivotally attached to the support arm bracket and a latch bracket secured to the wall for interlocking with the latch member.

The Lombardo, Olsen, Greer and Malott patents disclose awning-type devices. These devices provide shade and some level of privacy when affixed to window. However, they function to block incoming sunlight and airflow, which results in a dimmer room and stagnant interior air. The present invention affords greater privacy from those passersby looking directly into the window, while at the same time allowing airflow without obstructing the view of an occupant. The device attaches to the exterior of a window frame, allowing unhindered operation of the window. The window can be opened while the present invention is mounted, allowing air to flow therethrough while affording a level of privacy for the user and maintaining a measure of security by limiting the open window to a smaller cross section.

Several awnings devices were mentioned in the prior art, as well as a variety of window coverings such as storm windows and semi-transparent panels that attach to existing windows, but these devices fail to address the issues solved by the present invention. The present invention facilitates inflow of sunlight and fresh air, while simultaneously allowing privacy and security for the user. Its construction and mounting to an existing window frame is unique, while its design is substantially divergent from design elements in the prior art, consequently it is clear that there is a need in the art for an improvement to existing window covering devices. In this regard the instant invention substantially fulfills these needs.

SUMMARY OF THE INVENTION

In view of the foregoing disadvantages inherent in the known types of window coverings now present in the prior art, the present invention provides a new window covering wherein the same can be utilized for providing convenience for the user when seeking privacy and security, but desiring incoming airflow and light as well.

The present invention provides a semi-transparent, angled window covering that obscures inward vision from outside onlookers, while providing a permeable surface or opened gap to allow airflow and sunlight to penetrate through an opened window. The covering is mountable to a sliding screen so as not to alter its functionality, while providing security for the same by offering sunlight and airflow while the window is open. Using this product may allow consumers to feel safe and unobserved without shutting out light or fresh air. The user may also mount the device to the exterior of a window screen without exiting the building or room interior, allowing users in multi-level buildings to install the device with ease.

It is therefore an object of the present invention to provide a new and improved window covering device that has all of the advantages of the prior art and none of the disadvantages.

Another object of the present invention to provide a window covering that maintains privacy and security without shutting out light or fresh air. A particular object of the present invention is to maintain airflow in a room while restricting direct view from the outside looking into the window.

Another object of the present invention is to provide a window covering that is mountable to a sliding window screen and sliding rail therefor, wherein the covering and screen can be slid in unison along the rail.

Another object of the present invention is to provide a covering that is deployable with the user remaining on the interior side of a window frame, allowing a user to mount the device to any window frame, regardless of its height or number of floors about the ground.

Another object of the present invention is to provide an easily manufactured and installed device of simple construction, resulting in a low-cost solution that affords privacy and security to existing windows.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself, and manner in which it may be made and used, may be better understood by referring to the following description taken in connection with the accompanying drawings.

DETAILED DESCRIPTION OF THE INVENTION

Figure 1:
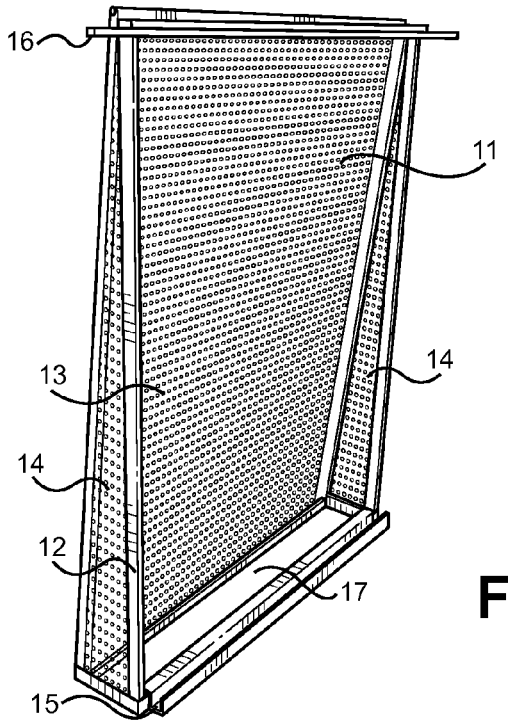
FIG. 1 is a perspective view of the present invention, wherein a gap is provided along the lower edge of the device for improved airflow and minimal sacrifice of security.

Reference is made herein to the attached drawings. Like reference numerals are used throughout the drawings to depict like or similar elements of the window covering device. For the purposes of presenting a brief and clear description of the present invention, the preferred embodiment will be discussed as used for providing security and privacy for a window without limiting airflow, sunlight or outward vision therethrough. The figures are intended for representative purposes only and should not be considered to be limiting in any respect.

Referring now to FIG. 1, there is shown a perspective view of the present invention. A front panel 11 is situated at an angle from a vertical frame 12 that mates against an existing window screen of a house or other structure. Two side panels 14 forming triangular sections span a distance from the angled front panel 11 to the vertical frame 12. At the base of the device, a bottom panel 17 is provided. This panel can be constructed of similar material as the aforementioned panels, or preferably be left as an opening through which a fresh air supply may flow through from the exterior and into an opened window. In a similar embodiment, the side panel 14 may be removable to increase airflow if desired. The material contemplated for the panels include a mesh screen, clouded glass or plastic, or similarly semi-opaque structures that limit inward visibility but provide outward vision when standing within a short proximity thereof The vertical frame 12 is attachable to a sliding window screen using two tabs 16 along its upper edge and a U-shaped channel 15 along its lower edge. The tabs 16 allow engagement of the sliding screen rail, while the channel 15 provides connection to the base of the screen. Together, the tabs 16 and channel 15 allow the present invention to travel in unison with the sliding screen, permitting a user to lower and open the device as normally accomplished when sliding the screen along its rails. A window can therefore be left open, while the screen is in a closed position in conjunction with the vertical frame 12 mateably attached thereto. This attachment scheme also permits application of the present invention from within the interior of a building or room. No exterior installation is necessary to engage the window screen with the channel 14 and sliding tabs 16.

Figure 2:
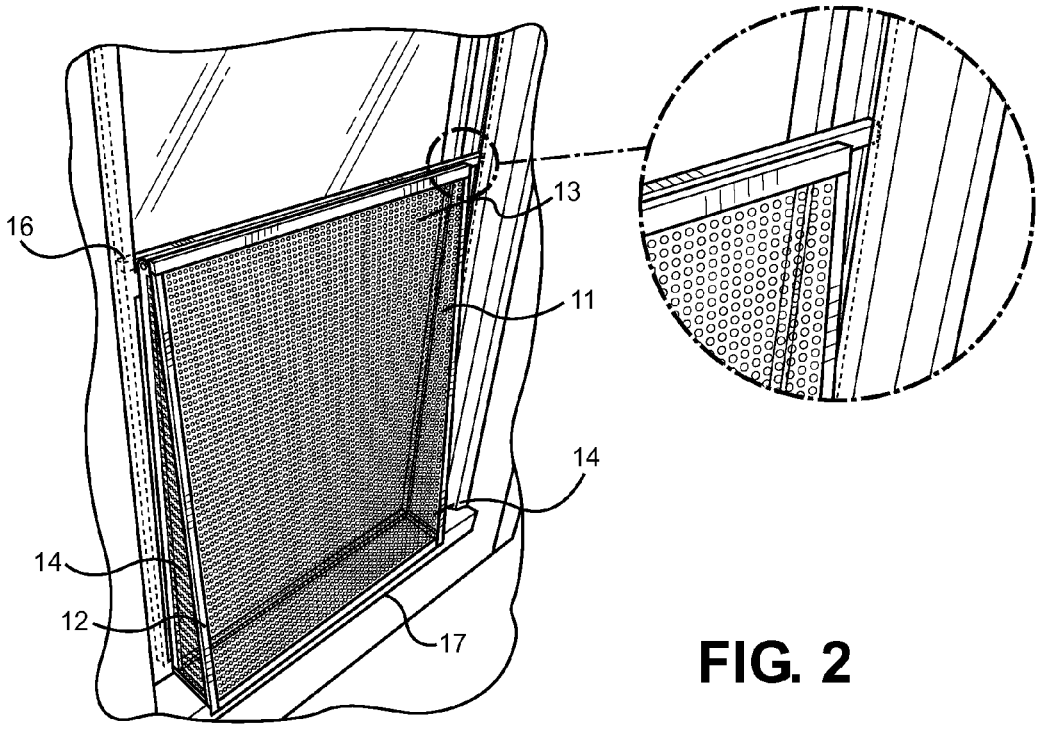
FIG. 2 is a perspective view of the present invention in a working position, wherein the device is attached to the exterior of a window frame.

Referring now to FIG. 2, there is shown a perspective view of the present invention in a working position. The angled front panel 11 may be made of a variety of materials that allow the user to select the level of privacy they desire, from opaque to translucent, including solid or screen construction. When installed, the device allows a user to open a window as would be customary in normal operation. The device provides a level of security for a user by allowing an open window to be limited to the gap 16 at the base of the device, while still permitting airflow via apertures 13 located along each panel. The apertures 13 are provided in an embodiment wherein a meshed screen is utilized for the panels, which allows relatively little obstruction of airflow therethrough and obscures inward vision due to the angled nature of the front panel 11 and the density of the apertures 13. Sunlight is similarly permitted therethrough with limited obstruction. In this position, the vertical frame 12 is mounted to a sliding screen that is positioned in the window frame.

The present invention allows consumers effective concealment of their home or building windows without blocking light or incoming fresh air. The invention may comprise a semi-transparent, opaque or unidirectional window covering made of clouded or stained sheets of glass or plastic, or alternatively provide a mesh screen device that allows optimal inflow and restricted vision. The device has an angled front panel 11 forming an outer frame, which connects to two side panels 14 that span a distance between the front panel 11 and a vertical frame 12. Each panel has a perimeter of frame members that support the device in the given configuration, providing support for wind gusts, rain fall, snow accumulation and trespasser tampering. The frame may be of any material contemplated by one skilled in the art, such as plastic or metallic structure. More secure embodiments of the present invention may desire stronger materials, including opaque plastic panels and a metallic frame. The angle of the front panel 11 allows use of a meshed screen while still providing a level of privacy. the angle with reduces inward visibility, particularly at far distances.

The primary source of novelty relates to the ability of the present invention to mount from the interior of a window frame, the mounting scheme that incorporates a sliding screen window, and the construction of the cover to allow inflow of air and light while contemplating multiple material systems for the panels.

In use, the device secures to a window screen using the lower edge channel 15 and to the sliding rail thereof using extending tabs 16 that protrude from the upper edge of the vertical frame. When in place, outward vision is not completely compromised, but inward vision is effectively eliminated. Use of screened panels allows the most efficient airflow in through the window, but is less effective at limiting inward vision. Close inspection of the window allows inward vision, but standoff vision is obscured by the density of the mesh and the angle of the front panel. The degree of airflow, privacy and security desired by the user will dictate the materials chosen in the final construction of the present invention; however its overall purpose and structure remain novel and advance the art in the field of window coverings.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A secondary window cover assembly for attachment to a sliding window screen to provide privacy and security, while allowing for inflow of air and sunlight therethrough, comprising:

an angled front panel having a perimeter frame, a vertical frame and two removable opposing side panels connecting said front panel and said vertical frame, wherein said front and side panels are constructed of an opaque material;

said side panels forming triangular sections and said front panel angling away from said vertical frame to form a lower open gap between said vertical frame and said front panel;

said vertical frame further comprising an upper and lower edge, said upper edge having two laterally protruding tabs extending horizontally from opposing ends of said upper edge for supporting said window cover on a top portion of a sliding window screen and for locking within said sliding screen rail, and said lower edge having a U-shaped channel for engaging a lower edge of said sliding window screen, wherein said laterally protruding tabs and said U-shaped channel are adapted to allow said window cover to travel in unison with said sliding screen, permitting raising and lowering of said window cover as normally accomplished when sliding said sliding window screen along its rails.

2. A device as in claim 1, wherein said front panel and said side panels comprise of a one-way vision material.

3. A device as in claim 1, wherein said vertical frame lower edge channel comprises a U-shape.

* * * * *